US009218784B2

(12) United States Patent
Myers

(10) Patent No.: US 9,218,784 B2
(45) Date of Patent: Dec. 22, 2015

(54) ADJUSTING THE COLOR OUTPUT OF A DISPLAY DEVICE BASED ON A COLOR PROFILE

(75) Inventor: Robert L. Myers, Windsor, CO (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 227 days.

(21) Appl. No.: 13/700,826

(22) PCT Filed: Jul. 16, 2010

(86) PCT No.: PCT/US2010/042214

§ 371 (c)(1), (2), (4) Date: Nov. 29, 2012

(87) PCT Pub. No.: WO2012/008964

PCT Pub. Date: Jan. 19, 2012

(65) Prior Publication Data

US 2013/0127928 A1 May 23, 2013

(51) Int. Cl.
*G09G 5/10* (2006.01)
*G09G 5/02* (2006.01)

(52) U.S. Cl.
CPC ..... *G09G 5/02* (2013.01); *G09G 2320/0242* (2013.01); *G09G 2320/0693* (2013.01); *G09G 2340/06* (2013.01)

(58) Field of Classification Search
CPC ..... G06T 15/04; G06T 11/001; G09G 2320/0242; G09G 2320/0693; G09G 2340/06; G09G 5/02; G09G 2320/0666; G09G 2320/0606; G09G 5/04; G09G 2370/04; G09G 2340/02; G09G 2360/02; G09G 2370/027; G09G 2320/0285; G09G 2320/0613; G09G 5/363; H04N 1/6011; H04N 1/603; H04N 1/6088; H04N 1/6097; H04N 9/73; H04N 9/69; H04N 1/6027; H04N 1/6072; H04N 1/56; H04N 9/3182; H04N 1/00129; H04N 1/32106; H04N 1/6008; H04N 1/6019; H04N 9/64; G06F 3/1208; G03G 2215/00063; G01J 3/46
USPC ..... 345/150, 153, 431, 589, 591–604, 690
See application file for complete search history.

(56) References Cited

U.S. PATENT DOCUMENTS 5,606,432 A * 2/1997 Ohtsuka et al. ..... 358/527
6,603,483 B1 * 8/2003 Newman ..... 345/593

(Continued)

FOREIGN PATENT DOCUMENTS

CN 1390333 A 1/2003
CN 1513167 A 7/2004

(Continued)

OTHER PUBLICATIONS

Office Action, CN Application No. 201080068079.1, Date Issued: Nov. 15, 2014, pp. 1-8.

*Primary Examiner* — Amare Mengistu
*Assistant Examiner* — Gloryvid Figueroa-Gibson
(74) *Attorney, Agent, or Firm* — Hewlett-Packard Patent Department

(57) ABSTRACT

Disclosed embodiments relate to adjusting the color output of a display device. For example, a method for adjusting the color output of a display device based on a color profile may comprise receiving, by a display device, a color profile indicative of the native properties of a display device, generating, by the display device, a color mapping based on the received color profile, and storing, by the display device, the color mapping. The method may further comprise displaying, by the display device, an image based on the stored color mapping.

13 Claims, 4 Drawing Sheets

(56) References Cited

U.S. PATENT DOCUMENTS

| | | | | |
|---|---|---|---|---|
| 6,650,771 | B1 * | 11/2003 | Walker | 382/162 |
| 7,453,601 | B2 * | 11/2008 | Kurumisawa et al. | 358/1.9 |
| 2010/0020242 | A1 * | 1/2010 | Lammers et al. | 348/642 |
| 2011/0292067 | A1 * | 12/2011 | Lee et al. | 345/589 |

FOREIGN PATENT DOCUMENTS

| | | | |
|---|---|---|---|
| CN | 101276170 | A | 10/2008 |
| CN | 101312487 | A | 11/2008 |
| KR | 10-0492209 | B1 | 6/2005 |
| KR | 10-0887000 | B1 | 3/2009 |

* cited by examiner

ADJUSTING THE COLOR OUTPUT OF A DISPLAY DEVICE BASED ON A COLOR PROFILE

BACKGROUND

Users expect display devices, such as computer monitors, to display colors with increasing accuracy. A display device may be adjusted or calibrated in order to provide accurate color depictions. The color output of a display device may be adjusted, for example, when a display device is initialized and periodically thereafter to maintain color accuracy. Because the process may be performed frequently, it is desirable to provide a simple and efficient method for calibrating a display device.

BRIEF DESCRIPTION OF THE DRAWINGS

In the accompanying drawings, like numerals refer to like components or blocks. The following detailed description references the drawings, wherein.

DETAILED DESCRIPTION

Figure 1:
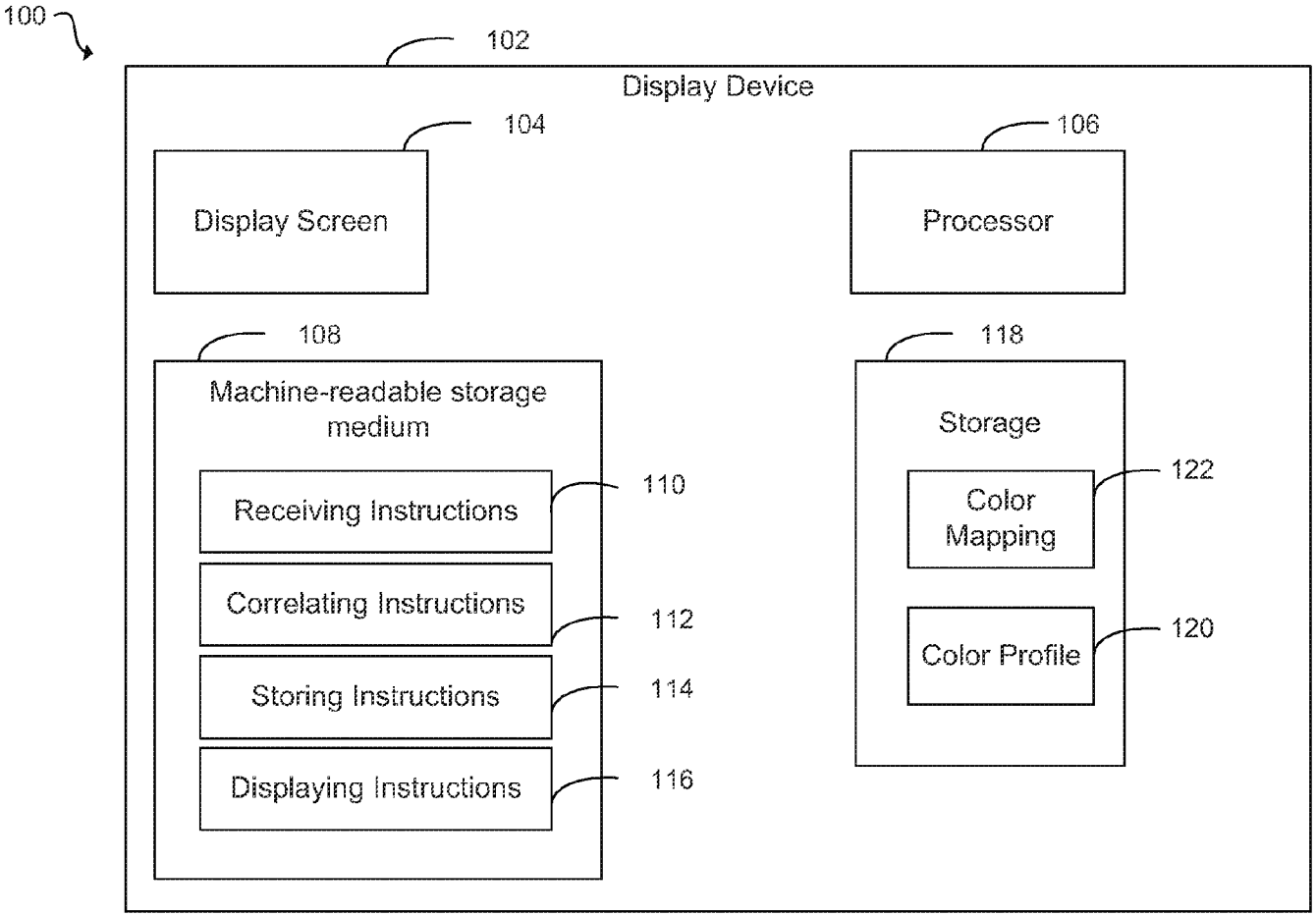
FIG. 1 is a block diagram illustrating one embodiment of a computing system.

A display device, such as a computer monitor, may be used to display images to a user. In some cases, the color output characteristics of a display may vary based on the type of display or variations in the assembly or materials used for producing a display device. Also, factors such as temperature, humidity, and aging may after a display device's color performance. As a result, a display device may output color differently than a standardized display device. Because a display device may receive image data designed to be displayed on a standardized display device, the image data may not appear as intended on a display device with other color characteristics.

A display device may be adjusted to alter how it displays image data, such as by creating a table for mapping image data. For example, when displaying an image, the display device may compare the received image data to the table to determine how to display the image data. To create the table, the color characteristics of a display device may be measured by hardware, such as a colorimeter. Software executed on a processor in communication with the hardware and the display device may be used to interpret the measurements taken by the hardware. Because color measuring hardware and its output format may vary, software designed to interpret data from the particular type of color measuring hardware may be used. In some cases, the color mapping software may be dependent on a particular operating system being loaded onto the processor. The software may use the color measurements from the hardware to create a mapping between input color information and the desired output color based on the measured color characteristics of the display device.

In one embodiment, a display device uses a color profile to update its color output. A color profile, such as an International Color Consortium profile, may provide a hardware independent characterization of a display device's color properties. For example, the color profile may be created by a colorimeter or other color hardware, but different colorimeters may output the same color profile. A color profile is used in some cases to alter output image data, such as data from a scanner, camera, or printer. For example, a profile may characterize the display characteristics of a display device, and the color profile may be used so that printed data matches the image shown on the display device or corrects for differences in the way the image was displayed on the display device. In one embodiment, a color profile is adapted to create a color mapping for updating the color output of a display device. For example, a display device may include processing power to create a color mapping between a color space and the display device using a color profile. The display device may then compare image data to the color mapping in order to determine how to display image data.

Embodiments discussed herein provide advantages. Using a color profile to create a color mapping for a display device allows a color updating process to be performed in a similar manner independent of the type of color measuring hardware. In addition, a standardized color characterization format may result in calculations for creating a color mapping being simple enough to be performed by a display device itself. Including color mapping logic within a display device may allow a display device to update its color output mapping without use of an additional processor, specialized software, or a particular operating system.

FIG. 1 is a block diagram illustrating one embodiment of a computing system 100. The computing system 100 may include a display device 102. The display device 102 may be any suitable display device, such as a computer monitor or mobile phone. The display device 102 may include a display screen 104, a processor 106, a machine-readable storage medium 108, and a storage 118. The display screen 104 may be, for example, a Liquid Crystal Display or a Cathode Ray Tube display. The display screen 104 may be used to display image data, such as pictures and videos, to a user.

The processor 106 may be any suitable processor, such as a central processing unit (CPU), a semiconductor-based microprocessor, or any other device suitable for retrieval and execution of instructions stored in the machine-readable storage medium 108. In one embodiment, the display device 102 includes logic instead of or in addition to the processor 106.

The storage 118 may be any suitable storage, such as a storage accessible by the processor 106. The storage 118 may be, for example, a volatile or non-volatile memory. In one embodiment, the storage 118 is a flash drive or a hard disk drive. The storage 118 may store, for example, a color mapping 122 and a color profile 120.

The color profile 120 may be any type of formatted information indicative of the color characteristics of the display device 102. In one embodiment, the color profile 120 is a standardized format that may be created by multiple types of color measuring hardware and may be processed by multiple types of display devices. For example, the color profile 120 may be independent of the color measuring hardware used to create it. The color profile 120 may be a standardized profile, such as an International Color Consortium profile. For example, the color profile 120 may be an International Color Consortium profile that describes the native color characteristics of the display device 102. The color profile 120 may be a proprietary format. It may contain data related to individual color characteristics or aggregated data. The color profile 120 may associate the color characteristics of the display device 102 with a color space, such as the sRGB color space or a custom color space. In one embodiment, the storage 118 stores multiple color profiles, such as multiple color profiles where each color profile is associated with a different color space. The storage 118 may store multiple color profiles, where each profile contains information about different aspects of the color characteristics of the display device 102.

In one embodiment, the color profile 120 is created by color measuring hardware, such as a colorimeter. The color profile 120 may be provided by a manufacturer. For example, a manufacturer could ship the display device with the color profile 120. In one embodiment, the color profile 120 may be updated, for example to reflect more recent color characteristics of the display device 102. The user may create a color profile 120 by using color measuring hardware. In one embodiment, a separate processor, such as a processor in an electronic device associated with the display device 102, receives data from color measuring hardware and creates the color profile 120. In one embodiment, the processor 106 receives data from color measuring hardware and creates the color profile 120.

The color mapping 122 may by any suitable type of mapping of color information, such as information about the primaries, white point, and light intensity displayed by the display device 102. The color mapping 122 may correlate input image data to image data for display on the display screen 104, such as based on the display device 102 color characteristics found in the color profile 120. In one embodiment, the color mapping 122 is associated with a color space. For example, the mapping may map an R value, a G value, and a B value for the sRGB color space. The color mapping 122 may be stored, for example, as one or more tables or as a multi-dimensional table. The storage 118 may store multiple color mappings, such as where each mapping corresponds to a different color space. The storage 118 may store the color mapping 122 in any manner that allows the processor 106 to analyze the color mapping 122 to determine how to display images on the display screen 104.

The machine-readable storage medium 108 may be any electronic, magnetic, optical, or other physical storage device that stores executable instructions or other data (e.g., a hard disk drive, random access memory, flash memory, etc.). In one embodiment, the machine-readable storage medium 108 and the storage 118 are combined into a single storage medium. The machine-readable storage medium 108 may include receiving instructions 110 for receiving the color profile 120, correlating instructions 122 for creating the color mapping 122, storing instructions 114 for storing the color mapping 122 in the storage 118, and displaying instructions 116 for displaying data on the display screen 104 based on the color mapping 122. The processor 106 may execute the instructions stored in the machine-readable storage medium 108.

Figure 2:
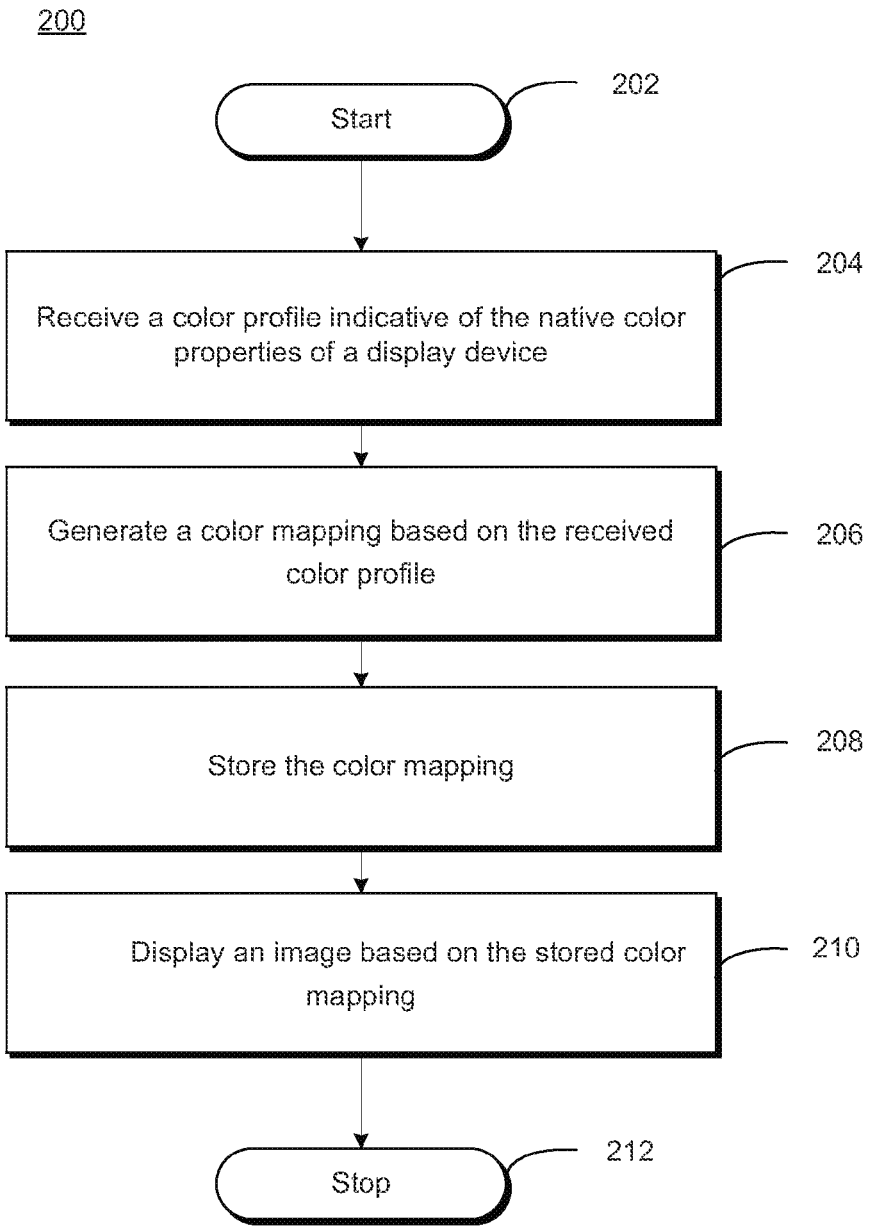
FIG. 2 is a flow chart illustrating one embodiment of a method for adjusting the color output of a display device based on a color profile.

FIG. 2 is a flow chart illustrating one embodiment of a method 200 for adjusting the color output of the display device 102 based on the color profile 120. The processor 106 may analyze the color profile 120 characterizing the native display characteristics of the display screen 104 and create the color mapping 122 based on the color profile 120. The processor 106 may store the created color mapping 122. The processor 106 may access the color mapping 122 to determine how to display image data on the display screen 104. By using the color mapping 122 to alter how images are displayed, the processor 106 may display images on the display screen 104 with improved coloration.

Beginning at block 202 and moving to block 204, the display device 102 receives the color profile 120, such as by executing the receiving instructions 110, indicative of the native color properties of the display device 102. The color profile 120 may include, for example, formatted information indicative of the color characteristics of the display device 102. The color profile 120 may be received in any suitable manner. The processor 106 may, for example, retrieve the color profile 120 from the storage 118. In one embodiment, the processor 106 creates the color profile 120, for example, by interpreting data received from color measuring hardware. The processor 106 may receive the profile from an end user. The processor 106 may receive the color profile 120 at any point, for example, in a factory setting, when the display device 102 is initially used by a consumer, or thereafter. In one embodiment, the processor 106 receives one type of color profile. In one embodiment, the processor 106 may execute instructions for processing multiple types of color profiles, such as color profiles based on differing standards or formats.

Moving to block 206, the display device 102 generates the color mapping 122 based on the received color profile 120, such as by executing the correlating instructions 112. For example, the processor 106 may extract color information from the color profile 120 and create the color mapping 122 based on the extracted color information. The processor 106 may determine color properties of the display device 102 by processing information extracted from the color profile 120. In one embodiment, the method for extracting information from the color profile 120 depends on the type of color profile 120 used. The processor 106 may convert the received color profile 122 into information compatible with a color mapping method and perform the color mapping method using the converted information. The color mapping method may be any suitable method for updating the color output of the display screen 104.

The information determined from the color profile may include any information relevant to color output, such as information about the color and light intensity displayed by the display device 102. The extracted information may provide information about the native color properties of the display screen 104 when the display data is not altered by a mapping function. The light intensity information extracted may, for example, correspond to the tone response or gamma curve of the display screen 104. The light intensity information may include information about the relationship between an input signal intensity and an output light intensity displayed by the display screen 104. In one embodiment, the light intensity information is related to a particular color or color space.

Color information extracted from the profile 120 may include, for example, information about how colors, such as primary colors, are displayed on the display screen 104. For example, in the sRGB color space, the color mapping 122 may correlate an R value, a G value, and a B value to output values for display on the display screen 104. The color information may include information about the white point of the display screen 104, such as the color combination used to display white on the display screen 104.

Any suitable information may be used to create the color mapping 122. In one embodiment, additional information about the display screen 104 not found in the color profile 120 is also used to create the color mapping 122. The processor 106 may use information about a standard display or a desired color output to create the color mapping 122. For example, the processor 106 may compare the color characteristics of the display screen 104 to the color characteristics of a desired color output and create the color mapping 122 such that an input color may be found in the color mapping 122 so that it is displayed as the desired color output when displayed with the color characteristics of the display screen 104.

In one embodiment, the color mapping 122 includes two mappings. For example, the color mapping 122 may include one color mapping for the light intensity of color output and another color mapping for the color output combinations to be displayed. The color mapping 122 may include multiple mappings or look up tables for one aspect of color output, such as one mapping for red, one mapping for green, and one mapping for blue. In one embodiment, the color mapping 122 includes one mapping that maps multiple aspects of color output.

In one embodiment, the color mapping 122 is tailored to a particular output color space, such as the sRGB color space. The processor 106 may create multiple color mappings for each color space or a single color mapping that may be used for multiple color spaces. In some cases, multiple mappings may be created such that a display can correlate between different received input color data. The processor 106 may create a color mapping 122 at any point. For example, an existing color mapping 122 may be updated to account for changes in the display device 102 due to factors such as temperature and humidity.

Proceeding to block 208, the display device 102 stores the color mapping 122. For example, the processor 106 may execute the storing instructions 114 to store the color mapping 122 in a storage medium within the display device 102, such as the storage 118. The processor 106 may access the stored color mapping 122 when displaying images on the display screen 104.

Continuing to block 210, the display device 102 displays an image based on the stored color mapping 122, such as by executing the displaying instructions 116. For example, the processor 106 may receive image data and compare the received image data to the stored color mapping 122. The processor 106 may look up the received image data to find the corresponding output in a table or other data structure in the color mapping 122. For example, the processor 106 may receive an RGB triple, and the processor 106 may look up the output color output and light intensity in the color mapping 122 for the red, green, and blue data. In one embodiment, the processor 106 looks up the data in multiple look up tables found in the color mapping 122. For example, the processor 106 may look up corresponding light intensity information in the color mapping 122 and then look up corresponding color information in the color mapping 122. The processor 106 may display the received image on the display screen 104 based on the characteristics found in the color mapping 122. The color mapping 122 may be stored in the storage 118 such that the processor 106 may access the color mapping 122 each time it displays image data. The color mapping 122 may be updated periodically such that the processor 106 looks up received image data in an updated color mapping. The method 200 moves to block 212 and ends.

Figure 3:
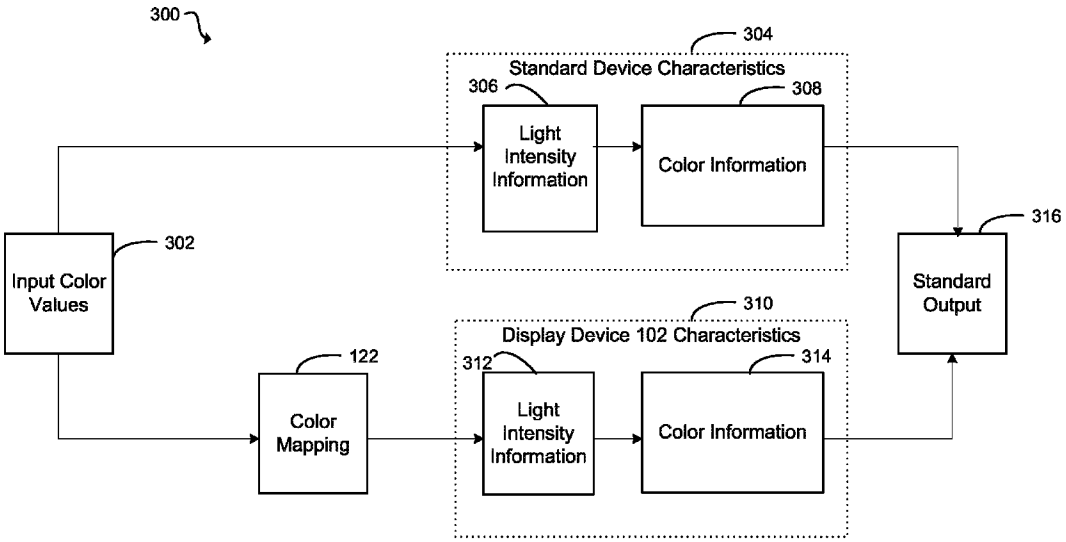
FIG. 3 is a block diagram illustrating one embodiment of a method for creating a color mapping.

FIG. 3 is a block diagram illustrating one embodiment of a process 300 for creating the color mapping 122. Input color values 302 represent, for example, image data that may be received for display on the display screen 104. For example, the input color values 302 may include an RGB triple. The display device 102 may construct or receive a model of a standardized display, such as the standard device characteristics 304, representing the output characteristics of a desired display device. The display device 102 may create a model of the native display characteristics of the display screen 104, for example, using information from the color profile 122. The processor 106 may then create the color mapping 122 designed so that when combined with the display device 102 characteristics 310, the input color values 302 result in the same or similar standard output 316 from the display device 102 as results from a standardized display device.

The standard device characteristics 304 may include, for example, light intensity information 306 and color information 308. The light intensity information 306 may include information about the output light intensity for a color, such as the relationship between an input signal intensity and output light intensity. In one embodiment, the light intensity information 306 includes light intensity information for multiple input color values, such as a light intensity for an R red value, a G green value, and a B blue value. The color information 308 may represents a correlation between an input color value and output color for a standardized display device. The light intensity information 306 and color information 308 may be represented, for example, by a matrix.

The display device 102 characteristics 310 may include, for example, light intensity information 312 and color information 314 displayed as a result of the native color characteristics of the display device 102. The light intensity information 312 may include the type of information similar to the light intensity information 306. The light intensity information 312 may include information about output light intensity from the display screen 104. The color information 314 may include information about the native color output from the display screen 104. The color output 314 may include information similar to the type of information found in the color information 308.

The processor 106 may determine the color mapping 122 based on the relationship between the display device 102 characteristics 310 relative to the standard display characteristics 304. For example, the processor 106 may determine a color mapping that when used with the display device 102 characteristics 310 produces the standard device characteristics 304. In one embodiment, to adjust for the differences between the color information 314 related to the display device 102 and the standard device color information 314, the processor 106 multiplies the inverse of the color information 314 by the color information 308 to create the color mapping 122 portion related to color output. The processor 106 may include information in the color mapping 122 to adjust the light intensity 312 to be similar to the light intensity 306. In one embodiment, the processor 106 creates a first look up table with the light intensity information 306 from the standard device characteristics 304 and a second look up table with the inverse of the light intensity information 312. When displaying data, the processor 106 may look up the input color values in one or more of the look up tables in the color mapping 122 prior to displaying the data on the display screen 104.

Figure 4:
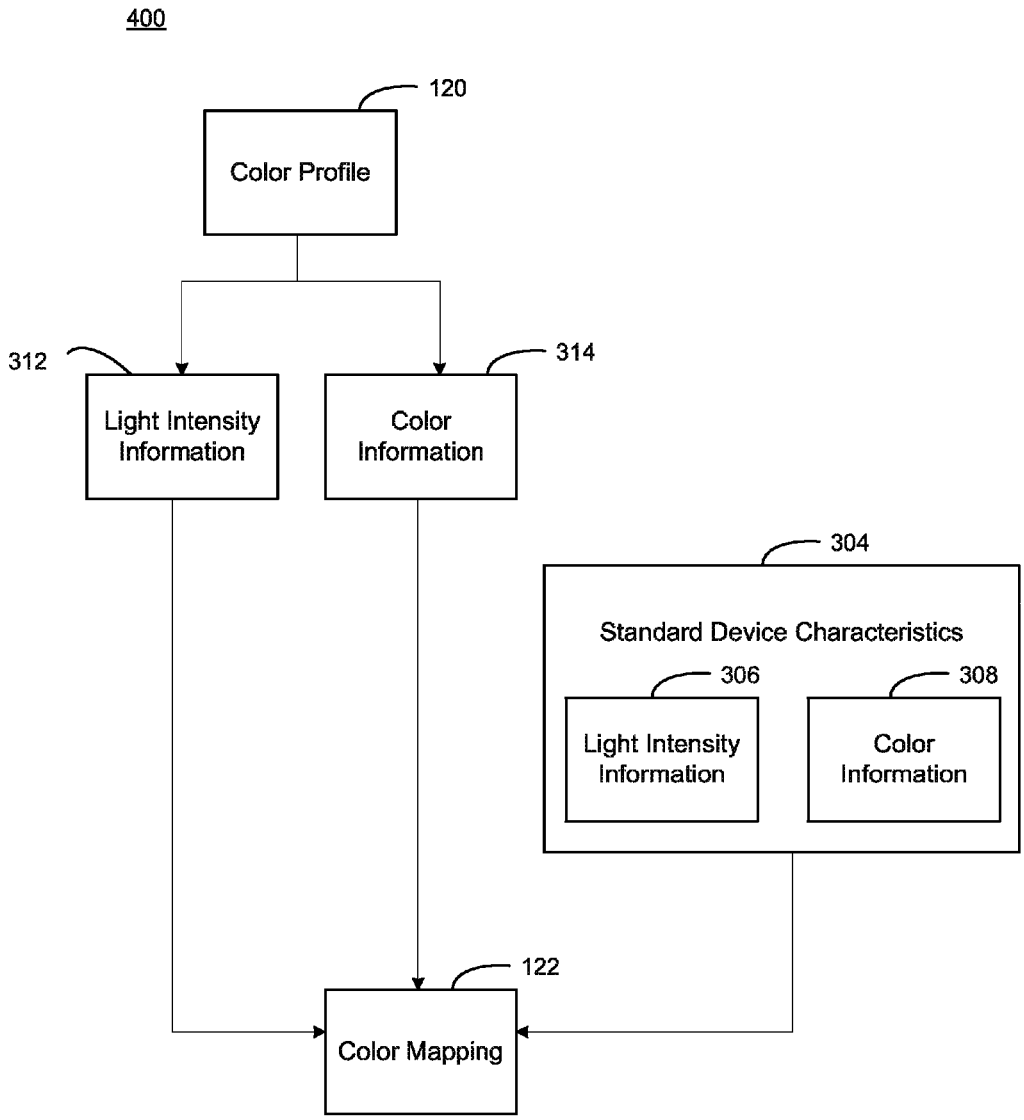
FIG. 4 is a flow chart illustrating one embodiment of a method for creating a color mapping.

FIG. 4 is a flow chart illustrating one embodiment of a method 400 for creating the color mapping 122. For example, some of the information shown in FIG. 3 used by the processor 106 to create the color mapping 122 may be determined based on the color profile 120. The processor 106 may receive the color profile 120, such as from a user uploading the color profile 120 from a Universal Serial Bus (USB) portable memory. The processor 106 may extract from the color profile the light intensity information 312, such as the native tone response or gamma curve, and the color information 314, such as the native color primaries and white point, or information used to create the light intensity information 312 and the color information 314. The method used by the processor 106 to extract the light intensity information 312 and the color information 314 may depend on the type of color profile received. The processor 106 may also use additional information not found in the color profile 120 to determine the color mapping 122. For example, the processor 106 may use information about standard device characteristics 304, such as the light intensity information 306 and the color information 308, to create the color mapping 122. In one embodiment, the processor 106 executes a standard color mapping algorithm to create the color mapping 122 after obtaining relevant color information.

Embodiments disclosed herein provide advantages. For example, using a color profile to create a color mapping may provide a simple and efficient method for adjusting the color output of a display device. The method may be simple enough to be performed by a display device itself. Furthermore, a color profile may standardize the color updating process such that specifically tailored software, hardware, or operating systems are not used to update color output.

The invention claimed is:

1. A display device comprising:

a display screen;

a memory; and a processor configured to:

obtain color profile data that is based on a standard display device that is external to the display device, the color profile data being for one or more color profiles stored in the memory, each color profile characterizing a desired color and intensity output of the display screen;

measure a set of display characteristics of the display screen at multiple instances over a given duration of time during which an output of the display screen changes; and determine a color mapping to adjust the set of measured display characteristics to corresponding values provided by at least one of the one or more color profiles, including adjusting the color mapping after one or more instances in which the set of display characteristics are measured.

2. The display device of claim 1, wherein the color profile format is independent of color measuring hardware.

3. The display device of claim 1, wherein the color profile comprises an International Color Consortium profile.

4. The display device of claim 1, wherein determining the color mapping comprises:

determining information about the color properties of the display screen based on the color profile; and creating the color mapping based on the determined information about the color properties of the display screen.

5. The display device of claim 1, wherein intensity output corresponds to tone response or a gamma curve of the display device.

6. The display device of claim 1, wherein determining the color mapping comprises (i) multiplying color information of the standard display device with an inverse of color information from native color properties of the display device, and (ii) adjusting light intensity from the native color properties of the display device to match light intensity of the standard display device.

7. A method for adjusting the color output of a display device based on a color profile, comprising:

obtaining, by the display device, color profile data that is based on a standard display device that is external to the display device, the color profile data being for one or more color profiles stored in a memory, each color profile characterizing a desired color and intensity output of the display screen;

measuring, by the display device, a set of display characteristics of the display screen at multiple instances over a given duration of time during which an output of the display screen changes; and determining, by the display device, a color mapping to adjust the set of measured display characteristics to corresponding values provided by at least one of the one or more color profiles, including adjusting the color mapping after one or more instances in which the set of display characteristics are measured.

8. The method of claim 7, wherein the color profile comprises an International Color Consortium profile.

9. The method of claim 7, further comprising:

receiving, by the display device, image data;

comparing, by the display device, the received image data to the color mapping; and displaying, by the display device, the image data based on the comparison.

10. The method of claim 7, wherein the color profile is independent of color measuring hardware.

11. The method of claim 7, wherein determining the color mapping comprises:

extracting, by the display device, color information from the color profile; and generating, by the display device, the color mapping based on the extracted color information.

12. The method of claim 7, wherein intensity output corresponds to tone response or a gamma curve of the display device.

13. The method of claim 7, wherein determining the color mapping comprises (i) multiplying color information of the standard display device with an inverse of color information from the native color properties of the display device, and (ii) adjusting light intensity from the native color properties of the display device to match light intensity of the standard display device.

* * * * *

UNITED STATES PATENT AND TRADEMARK OFFICE

CERTIFICATE OF CORRECTION

PATENT NO. : 9,218,784 B2
APPLICATION NO. : 13/700826
DATED : December 22, 2015
INVENTOR(S) : Robert L. Myers It is certified that error appears in the above-identified patent and that said Letters Patent is hereby corrected as shown below:

Specification

In column 1, line 39, delete "after," and insert -- alter --, therefor.

Claims

In column 8, line 45, in Claim 13, delete "from the" and insert -- from --, therefor.

Signed and Sealed this
Twenty-eighth Day of June, 2016

Michelle K. Lee

Michelle K. Lee
*Director of the United States Patent and Trademark Office*